United States Patent [19]

Ferraro

[11] Patent Number: 5,058,848

[45] Date of Patent: Oct. 22, 1991

[54] READING MATERIAL HOLDER

[76] Inventor: James A. Ferraro, 1851 Marsh Rd., Wilmington, Del. 19810

[21] Appl. No.: 627,977

[22] Filed: Dec. 17, 1990

[51] Int. Cl.[5] ..... A47B 5/04

[52] U.S. Cl. ..... 248/441.1; 248/445

[58] Field of Search ..... 248/444.1, 445, 446, 248/447, 451, 441.1, 448, 450; 5/507

[56] References Cited

U.S. PATENT DOCUMENTS

| | | | |
|---|---|---|---|
| 2,359,895 | 10/1944 | Burton | 248/445 |
| 2,448,734 | 9/1948 | Phillips | 248/444.1 X |
| 2,896,364 | 7/1959 | McCollister | 248/445 |
| 3,350,150 | 10/1967 | Schwarm | 248/451 X |
| 3,889,914 | 6/1975 | Torme | 248/445 |
| 3,952,989 | 4/1976 | Bannister Hatcher | 248/444.1 X |
| 4,188,740 | 2/1980 | Forman | 248/445 X |
| 4,465,255 | 8/1984 | Hill | 248/447 X |
| 4,867,407 | 9/1989 | Becker | 248/444.1 |

FOREIGN PATENT DOCUMENTS

| | | | |
|---|---|---|---|
| 1478012 | 6/1977 | United Kingdom | 248/444.1 |

*Primary Examiner*—Ramon O. Ramirez

*Attorney, Agent, or Firm*—John S. Munday

[57] ABSTRACT

A device for positioning reading material for use by a person in the horizontal position. The device includes a frame, including a base, a vertical arm extending above the base, and a horizontal arm extending over the location of the person. Also included is a housing for mounting the horizontal portion of the frame. The housing includes a back plate extending horizontally in the frame and a reader plate frame for housing a reader plate. The reader plate frame is below the back plate and is spaced therefrom to position reading material in an open orientation facing the person.

Also include are first and second clear reader plates mounted horizontally in the reader plate frame to enclose both sides of reading material while leaving a spaced region between the plates for access to the reading material by a person in the horizontal position. An adjustable leaf spring is located on the exterior of the first reader plate for receiving the end of pages of reading material moved from under said the plate through the spaced region. The spring, which is adjustable to reach only the edge of the page, holds the pages which have been turned on the exterior of the first reader plate so the person can read the other side of the page.

11 Claims, 1 Drawing Sheet

READING MATERIAL HOLDER

FIELD OF THE INVENTION

The present invention relates to a reading material holding device for holding books, magazines and the like in position for reading by a person lying horizontally, such as in bed. More particularly, the invention relates to a device for holding books, magazines and the like between plates, so that the reader can comfortably read and turn the pages of the device without disassembly of the device.

BACKGROUND OF THE INVENTION

A chiropractic analysis of the effects of prolonged reading in seated, prone and side lying positions confirms the muscle tension and improper posture which is experienced by one reading in those positions. These positions tend to produce poor posture, generalized muscle tension, muscle aches, as well as causing stress to the spine and related areas.

Even though students, professionals and recreational readers experience substantial discomfort from reading in these positions, they continue to do so without thought of a solution. For people with any type of back pain, or bedridden disability, reading becomes an uncomfortable chore, if not impossible.

One problem with reading in a seated position is that flexion of the neck is caused, due in part to the angle of the support, normally a desk. This flexion of the neck adds to the effect of gravity to cause muscle tension and improper stress on the spine. Back problems result.

A number of solutions have been proposed, as various cleverly engineered designs attempt to mechanically substitute for the arms of the reader. However, as is noted below, none of these prior devices recognize the need for providing a device which leads the reader to adopt the most stress free position for reading.

McCollister U.S. Pat. No. 2,896,364 is one example of prior art designs in which the reader's neck is forced into flexion. Moreover, there is no provision for turning the pages of the book, thereby adding strain to the reader. Other patent which cause unwanted flexion on the reader's neck are U.S. Pat. Nos. 2,359,895 and 4,191,354. None of the prior art even consider a stress free reading position, and certainly none provide for stress free and convenient reading, even by ill patients. One must be healthy to use the prior art devices, yet prolonged use will most likely result in stress if not actual harm to the reader.

None of the prior art devices known are capable of providing a reading position which is chiropractically sound and which eliminates rather than adds to strain on the spine. It is, therefore, a primary object of the present invention to provide a device which is inherently used in a position by the reader which reduces strain on the spine.

Another object of this invention is to provide a device which can be used with a minimum effort, such as by ill patients who are weak, and even infirm, but who have a desire to read during their time of incapacity.

Other objects will appear hereinafter.

SUMMARY OF THE INVENTION

It has now been discovered that the above and other objects of the present invention may be accomplished in the following manner. Specifically, an improved device for positioning reading material for use by a person in the horizontal position is provided by the present invention.

The device is provided with a frame, including a base portion, a vertical portion extending above the base, and a horizontal portion for extension over the location of the person. Also included is a housing with means for mounting the housing on the horizontal portion of the frame.

The housing includes a back plate extending horizontally in the frame and a reader plate frame for housing reader plates. The frame is positioned below the back plate and spaced therefrom to position reading material in an open orientation facing the person. First and second clear reader plates are mounted horizontally in the reader plate frame to enclose both sides of the reading material while leaving a spaced region between the plates for access to the pages by the person lying in a horizontal position.

All the reader needs to do is reach up with one hand and turn the page from under the right reader plate and place it under bias means on the exterior of the first reader plate. This bias means is for receiving pages of reading material moved from under the second plate through the spaced region to thereby hold the pages on the exterior of the first reader plate.

A preferred embodiment includes a back plate and reader plate frame which are selectively adjustable for positioning reading material therebetween in readable orientation. Also preferred is providing a leaf spring for the bias means so that it is selectively movable with respect to the spaced region to adjust the portion of the page held by it.

The device may also include an adjustment means in the vertical part of the frame to adjust the height of the horizontal portion above the reader. This adjustment means includes at least two telescoping members and lock means for selectively preventing movement between the telescoping members.

The preferred embodiment is designed where the reader plates are fixedly mounted in the reader plate frame, but the reader plate frame is adjustable with respect to the back plate to accommodate different sizes of reading material. It is also useful to include a cervical support pillow attached to the frame and movable for use by the reader in the horizontal position. This pillow will increase comfort and give therapuetic effect to the central spine.

BRIEF DESCRIPTION OF THE DRAWINGS

For a more complete understanding of the invention, reference is hereby made to the drawings, where like numbers refer to like elements, in which.

DETAILED DESCRIPTION OF THE INVENTION

Figure 1:
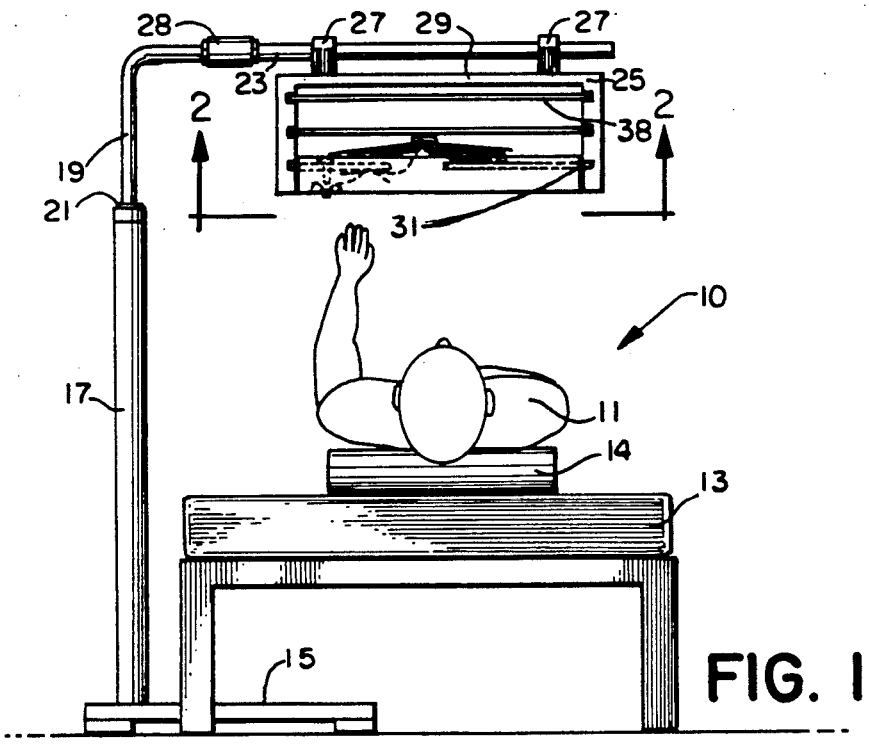
FIG. 1 is a schematic, end elevational view of the device of the present invention, shown in position for use by a person in a horizontal position and within reach of the person using the device.
Figure 2:
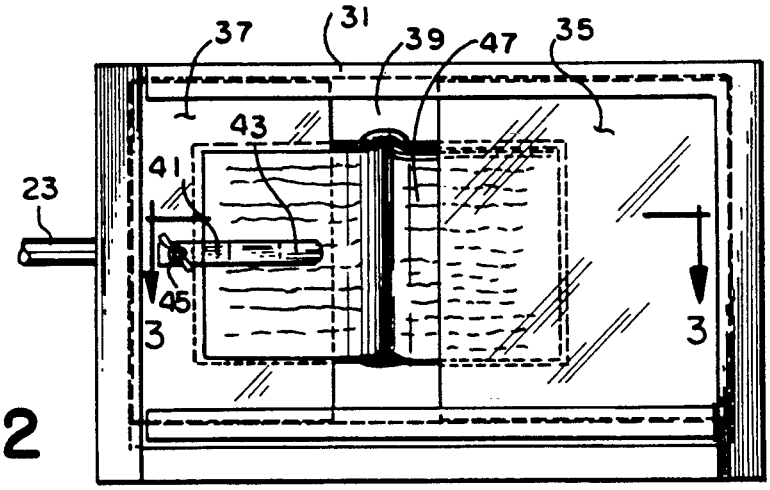
FIG. 2 is a view taken along the line 2—2 in FIG. 1.
Figure 3:
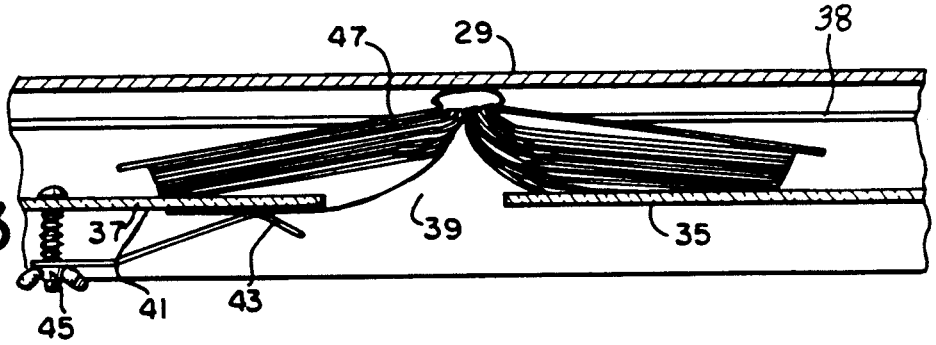
FIG. 3 is an enlarged view of the portion of the device shown in FIG. 2 taken along line 3—3.

As shown in FIG. 1, the device generally shown by reference 10 is positioned for use by a patient 11 lying in a bed 13. In the preferred embodiment, the patient 11 has a cervical support pillow 14, which is positioned under the neck and which prevents any stress or strain on the patient as he or she lies in bed.

The device 10 includes a base portion 15 which is positioned under bed 13 to provide leveraged support. Extending up from base 15 is a vertical portion 17 which is sturdy enough to support the device as described herein. In order to adjust the relative height of the reader element with respect to the reader 11, upper vertical portion 19 is adjustable, such as by the telescopic fit into portion 17, secured by clamping lock 21 at the appropriate height as desired.

Extending horizontally from upper vertical portion 19 is horizontal member 23, which supports housing 25 by brackets 27. Fitting 28 allows for the device to also be used as a standing or seated reading device, as horizontal member 23 may be adjusted to provide the desired angle of location of housing 25.

Housing 25 comprises a back plate 29 and a reader plate frame 31, where reading material is placed therebetween. Reader plate frame 31 includes a first clear reader plate 35 and a second clear reader plate 37. Plates 35 and 37 are spaced from one another by an open space 39 to provide access to the reading material.

The second reader plate 37 has a narrow opening 41 which permits positioning of a biasing means in the form of leaf spring 43. Spring 43 is adjustably positioned by wing nut assembly 45 so that the end of spring 43 contacts the plate 37 at a place near the edge of the page of the reading material 47. As each page is turned, it is inserted under the edge of spring 43 and is held in place so that the reader can read the other side of the page.

Reader plate 35 is positioned with respect to back plate 29 so that the book 47 or other reading material is firmly held in place. At the same time, the pages can easily be reached through open space 39, and can be turned one at a time and placed under spring 43.

The reader plate frame 31 is designed to fit in grooves 38. Grooves 38 are placed at several distances from back plate 29 to accommodate different sizes of books 47. The device of this invention operates most efficiently when there is slight tension on book 47 between back plate 29 and reader plate frame 31 holding the reader plates 35 and 37. This invention is designed to accommodate almost any size book and with the grooves 38, the space between the back plate 29 and the reader plates 35 and 37 will provide the ideal tension for turning the pages.

The use of the present invention is simple, and yet it is amazingly effective in keeping the reader free from tension and stress, particularly on the spine and neck regions of the body. The present invention may be used by those who are confined to bed, either by illness, disease or injury. It is also useful for students and persons working at home. Of course it is excellent for recreational reading, preventing any stress while providing an opportunity to relax and read.

While particular embodiments of the present invention have been illustrated and described, it is not intended to limit in invention, except as defined by the following claims.

I claim:

1. A device for positioning reading material for use by a person in a horizontal position, comprising:

a frame, including a base portion, a vertical portion extending above said base, and a horizontal portion for extension over the location of the person;

a housing including means for mounting said housing on said horizontal portion of said frame, said housing including a back plate extending horizontally in said frame;

a reader plate frame for housing a reader plate and mounted on said frame below said back plate and spaced therefrom to position reading material in an open orientation facing said person;

first and second clear reader plates mounted horizontally in said reader plate frame to enclose both sides of reading material while leaving a spaced region between said plates for access to said reading material by said person in a horizontal position; and bias means on the exterior of one of said reader plates for receiving pages of reading material moved from under the other of said plates through said spaced region to thereby hold said pages on said exterior of said first reader plate.

2. The device of claim 1, wherein said back plate and reader plate frame are selectively adjustable for positioning reading material therebetween in readable orientation.

3. The device of claim 1, wherein said bias means comprises a leaf spring selectively movable with respect to said spaced region to adjust the portion of the page held by said biasing means.

4. The device of claim 1, wherein said vertical portion of said frame includes adjustment means to adjust the height of said horizontal portion above said reader, comprising at least two telescoping members and lock means for selectively preventing movement between said telescoping members.

5. The device of claim 1, wherein said reader plates are fixedly mounted in said reader plate frame.

6. The device of claim 1, which further includes a cervical support pillow attached to said frame and movable for use by said reader in said horizontal position.

7. A device for positioning reading material for use by a person in a horizontal position, comprising:

a frame, including a base portion, a vertical portion extending above said base, and a horizontal portion for extension over the location of the person, said vertical portion of said frame including adjustment means to adjust the height of said horizontal portion above said reader;

a housing including means for mounting said housing on said horizontal portion of said frame, said housing including a back plate extending horizontally in said frame;

a reader plate frame for housing a reader plate and mounted on said frame below said back plate and spaced therefrom to position reading material in an open orientation facing said person, said back plate and reader plate frame being adjustable for positioning reading material therebetween in readable orientation;

first and second clear reader plates mounted horizontally in said reader plate frame to enclose both sides of reading material while leaving a spaced region between said plates for access to said reading material by said person in a horizontal position; and bias means on the exterior of one of said reader plates for receiving pages of reading material moved from under the other of said plates through said spaced region to thereby hold said pages on said exterior of said first reader plate.

8. The device of claim 7, wherein said adjustment means comprises at least two telescoping members and lock means for selectively preventing movement between said telescoping members.

9. The device of claim 7, wherein said reader plates are fixedly mounted in said reader plate frame.

10. The device of claim 7, which further includes a cervical support pillow attached to said frame and movable for use by said reader in said horizontal position.

11. The device of claim 7, wherein said bias means comprises a leaf spring selectively movable with respect to said spaced region to adjust the portion of the page held by said biasing means.

* * * * *